US008109802B2

(12) United States Patent
Chui et al.

(10) Patent No.: US 8,109,802 B2
(45) Date of Patent: Feb. 7, 2012

(54) TOY HELICOPTER HAVING A STABILIZING BUMPER

(75) Inventors: Chi Keung Chui, Kowloon (HK); Paulo Kang, Burbank, CA (US)

(73) Assignee: Mattel, Inc., El Segundo, CA (US)

( * ) Notice: Subject to any disclaimer, the term of this patent is extended or adjusted under 35 U.S.C. 154(b) by 431 days.

(21) Appl. No.: 12/202,861

(22) Filed: Sep. 2, 2008

(65) Prior Publication Data

US 2009/0075551 A1 Mar. 19, 2009

Related U.S. Application Data

(60) Provisional application No. 60/972,777, filed on Sep. 15, 2007.

(51) Int. Cl.
*A63H 27/127* (2006.01)

(52) U.S. Cl. ..... 446/36

(58) Field of Classification Search ..... 446/34–38, 446/46–48, 57, 230, 232; 244/12.1, 12.2, 244/5, 6, 23 C, 34 A, 121, 7 A
See application file for complete search history.

(56) References Cited

U.S. PATENT DOCUMENTS

| | | | | |
|---|---|---|---|---|
| 1,332,175 | A | 2/1920 | Hashimoto | |
| 2,138,168 | A | 11/1938 | Horak | |
| 2,382,347 | A | 8/1945 | Streater | |
| 2,402,349 | A | 6/1946 | Sikorsky | |
| 2,432,774 | A | 12/1947 | Lefustec | |
| 2,437,330 | A | 3/1948 | Mullgardt | |
| 2,765,992 | A * | 10/1956 | Oberg | 244/6 |
| 2,806,662 | A | 9/1957 | Yonkers | |
| 2,937,473 | A | 5/1960 | Vlachos | |
| 2,938,298 | A | 5/1960 | Apostolescu | |
| 2,945,642 | A | 7/1960 | Nofi | |
| 2,949,693 | A | 8/1960 | McRoskey | |
| 2,996,269 | A * | 8/1961 | Parry | 244/17.19 |
| 3,082,977 | A | 3/1963 | Arlin | |
| D197,447 | S | 2/1964 | Friedrich | |
| 3,129,905 | A * | 4/1964 | Taylor | 244/210 |
| 3,182,422 | A | 5/1965 | Ryan | |
| 3,253,805 | A * | 5/1966 | Taylor | 244/12.2 |
| D209,526 | S * | 12/1967 | Dunbar | D21/444 |

(Continued)

FOREIGN PATENT DOCUMENTS

DE 102005028736 A1 12/2006

(Continued)

*Primary Examiner* — Gene Kim
*Assistant Examiner* — Alyssa Hylinski
(74) *Attorney, Agent, or Firm* — Panitch Schwarze Belisario & Nadel LLP

(57) ABSTRACT

A toy helicopter has a fuselage having a front end a rear end and two lateral sides. A main motor is supported from the fuselage. A main rotor is operably connected to the motor and has at least one rotor blade that rotates about a center axis generally laterally centered with respect to the fuselage. The at least one rotor blade is configured and positioned to provide lift and has a rotational path having a maximum radius. A bumper is fixedly connected to the fuselage, is spaced entirely axially downwardly from the at least one rotor blade and extends radially outwardly from and at least partially around the fuselage. At least a portion of the bumper has a maximum radial dimension from the center axis at least as great as the maximum radius of the rotational path of the at least one rotor blade.

21 Claims, 6 Drawing Sheets

U.S. PATENT DOCUMENTS 3,394,906 A 7/1968 Rogers
3,477,168 A 11/1969 Trodglen, Jr.
3,488,882 A 1/1970 Scott
D217,000 S 3/1970 Getz
3,525,484 A 8/1970 Mueller
3,583,659 A 6/1971 Lermusiaux
3,603,033 A 9/1971 Mueller
3,689,011 A 9/1972 Torelli
3,791,067 A 2/1974 Guttman
3,955,817 A 5/1976 Davis
4,050,652 A 9/1977 DeToia
4,065,873 A 1/1978 Jones
4,184,654 A 1/1980 Herrera
4,335,537 A 6/1982 Walker
4,390,148 A 6/1983 Cudmore
4,461,436 A 7/1984 Messina
4,720,059 A 1/1988 Stearns, Jr.
4,730,795 A 3/1988 David
D321,732 S 11/1991 Furst
5,071,383 A 12/1991 Kinoshita
5,190,242 A 3/1993 Nichols
5,251,847 A * 10/1993 Guimbal ..... 244/17.19
5,252,100 A 10/1993 Osawa et al.
5,259,802 A 11/1993 Yang
5,297,759 A 3/1994 Tilbor et al.
5,304,090 A 4/1994 Vanni
5,324,223 A 6/1994 Yang
5,381,988 A 1/1995 Kattas
5,429,542 A 7/1995 Britt, Jr.
5,492,494 A 2/1996 Keennon
5,516,060 A 5/1996 McDonnell
5,634,839 A 6/1997 Dixon
5,672,086 A 9/1997 Dixon
5,947,785 A 9/1999 Bausch
5,974,785 A 11/1999 Cunningham et al.
D422,322 S 4/2000 Wei
6,170,778 B1 1/2001 Cycon et al.
6,224,452 B1 5/2001 Morse
D456,050 S 4/2002 Bao
6,450,446 B1 9/2002 Holben
6,467,724 B2 10/2002 Kuenkler
6,550,715 B1 * 4/2003 Reynolds et al. ..... 244/7 B
6,659,395 B2 12/2003 Rehkemper et al.
6,688,936 B2 * 2/2004 Davis ..... 446/37
6,758,436 B2 7/2004 Rehkemper et al.
D496,695 S 9/2004 Davis
6,793,172 B2 9/2004 Liotta
6,811,460 B1 11/2004 Tilbor et al.
6,834,829 B2 * 12/2004 Dunagin, Jr. ..... 244/26
6,843,699 B2 1/2005 Davis
6,899,586 B2 5/2005 Davis
6,976,653 B2 * 12/2005 Perlo et al. ..... 244/12.2
7,100,866 B2 9/2006 Rehkemper et al.
7,134,840 B2 11/2006 Vogel
7,178,758 B2 2/2007 Rehkemper
7,204,453 B2 4/2007 Muren
D546,904 S 7/2007 Bowen et al.
7,273,195 B1 * 9/2007 Golliher ..... 244/17.11
D570,924 S 6/2008 Wai
7,416,466 B2 8/2008 Isawa
7,798,883 B2 9/2010 Elson et al.
7,802,755 B2 * 9/2010 Poltorak ..... 244/17.27
2002/0142699 A1 10/2002 Davis
2004/0200924 A1 10/2004 Clark et al.
2005/0082421 A1 4/2005 Perlo et al.
2005/0121553 A1 6/2005 Isawa et al.
2006/0060693 A1 * 3/2006 Poltorak ..... 244/17.11
2006/0121818 A1 6/2006 Lee et al.
2006/0121819 A1 6/2006 Isawa
2007/0012818 A1 * 1/2007 Miyazawa et al. ..... 244/17.25
2007/0031253 A1 2/2007 Muren
2007/0037468 A1 2/2007 Ong
2007/0105474 A1 5/2007 Gotou et al.
2007/0215746 A1 9/2007 Rieken et al.
2007/0215750 A1 * 9/2007 Shantz et al. ..... 244/17.23

FOREIGN PATENT DOCUMENTS

JP 2008093204 4/2008

* cited by examiner

TOY HELICOPTER HAVING A STABILIZING BUMPER

CROSS-REFERENCE TO RELATED APPLICATIONS

This application claims the benefit of U.S. Provisional Patent Application No. 60/972,777 filed Sep. 15, 2007 entitled "Miniature Toy Helicopter Having Stabilizing Bumper", incorporated by reference herein in its entirety.

BACKGROUND OF THE INVENTION

The present invention relates to motorized model or miniature toy helicopters.

In general, helicopters are flying machines with the ability to hover and fly forwards, backwards, and sideways. Toy helicopters, that replicate the motion of a real helicopter, are well known for providing amusement. However, when full-size helicopters are scaled down to model or miniature proportions, their small rotor systems are typically inefficient at producing lift and the rotor system is often drastically simplified resulting in less stable control. Toy helicopters are particularly unstable during take-off because the rotor blades are not at full speed when the lift generated by the rotor blades is sufficient to lift the lightweight device off of the ground. Having the support legs close to the geometric center of the vehicle, similar to a full scale model, allows the toy helicopter to take off at an angle. As a result, the toy will take off in an unstable or slanted state typically resulting in a crash or unintentional contact with another object. Additionally, because toy helicopters may be used indoors were there are walls and additional objects in close proximity, the rotor blades can hit a wall or other object causing the toy helicopter to crash.

What is therefore needed is a toy helicopter having improved stability, especially during take off and protection to the rotor blades during operation.

BRIEF SUMMARY OF THE INVENTION

Briefly stated, the present invention is directed to a toy helicopter which has a fuselage having a front end a rear end and two lateral sides. A main motor is supported from the fuselage. A main rotor is operably connected to the motor and has at least one rotor blade that rotates about a center axis generally laterally centered with respect to the fuselage. The at least one rotor blade is configured and positioned to provide lift and has a rotational path having a maximum radius. A bumper is fixedly connected to the fuselage, spaced entirely axially downwardly from the at least one rotor blade and extends radially outwardly from and at least partially around the fuselage. At least a portion of the bumper has a maximum radial dimension from the center axis at least as great as the maximum radius of the rotational path of the at least one rotor blade.

BRIEF DESCRIPTION OF THE SEVERAL VIEWS OF THE DRAWINGS

The foregoing summary, as well as the following detailed description of a preferred embodiments of the invention, will be better understood when read in conjunction with the appended drawings. For the purpose of illustrating the invention, there is shown in the drawings an embodiments which are presently preferred. It should be understood, however, that the invention is not limited to the precise arrangements and instrumentalities shown.

In the drawings.

DETAILED DESCRIPTION OF THE INVENTION

Figure 1:
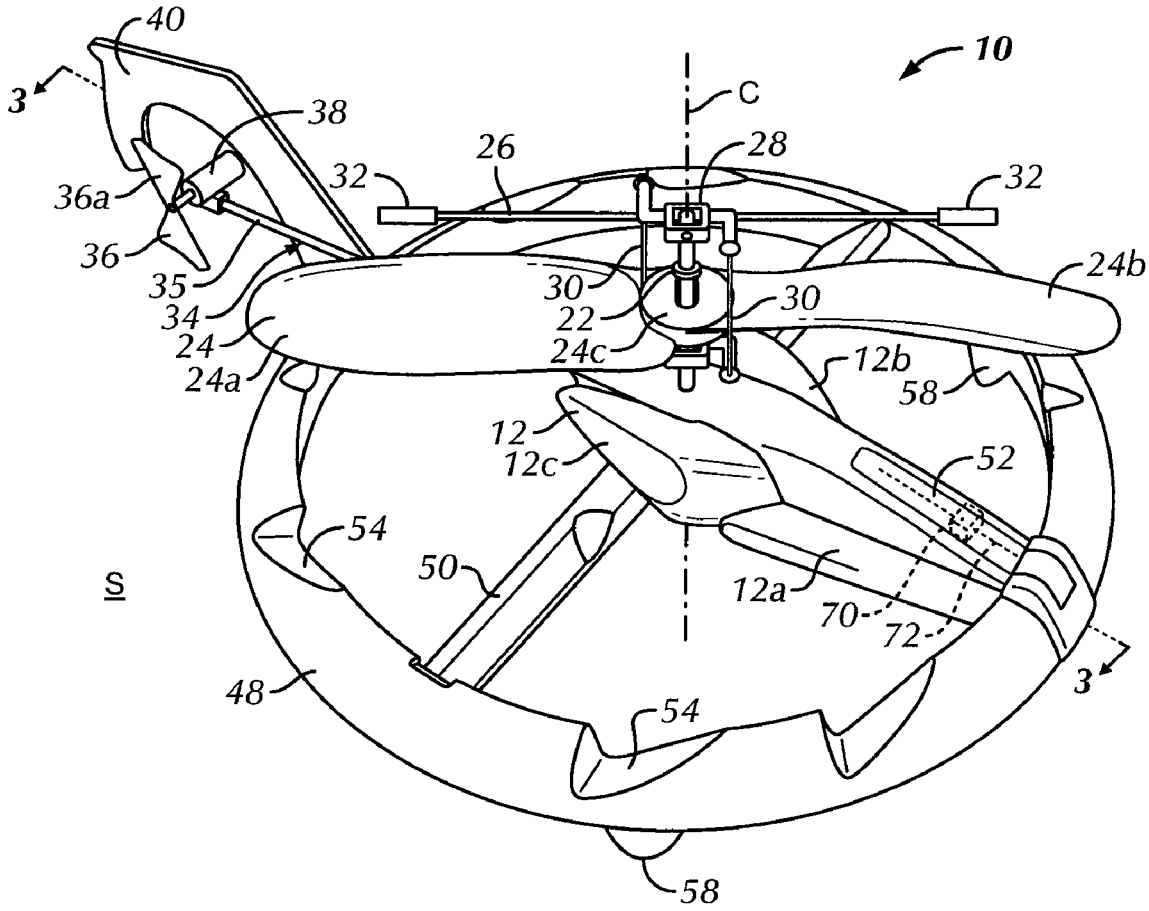
FIG. 1 is a perspective view of the upper right side of a toy helicopter having a stabilizing bumper in accordance with a first preferred embodiment of the present invention.
Figure 2:
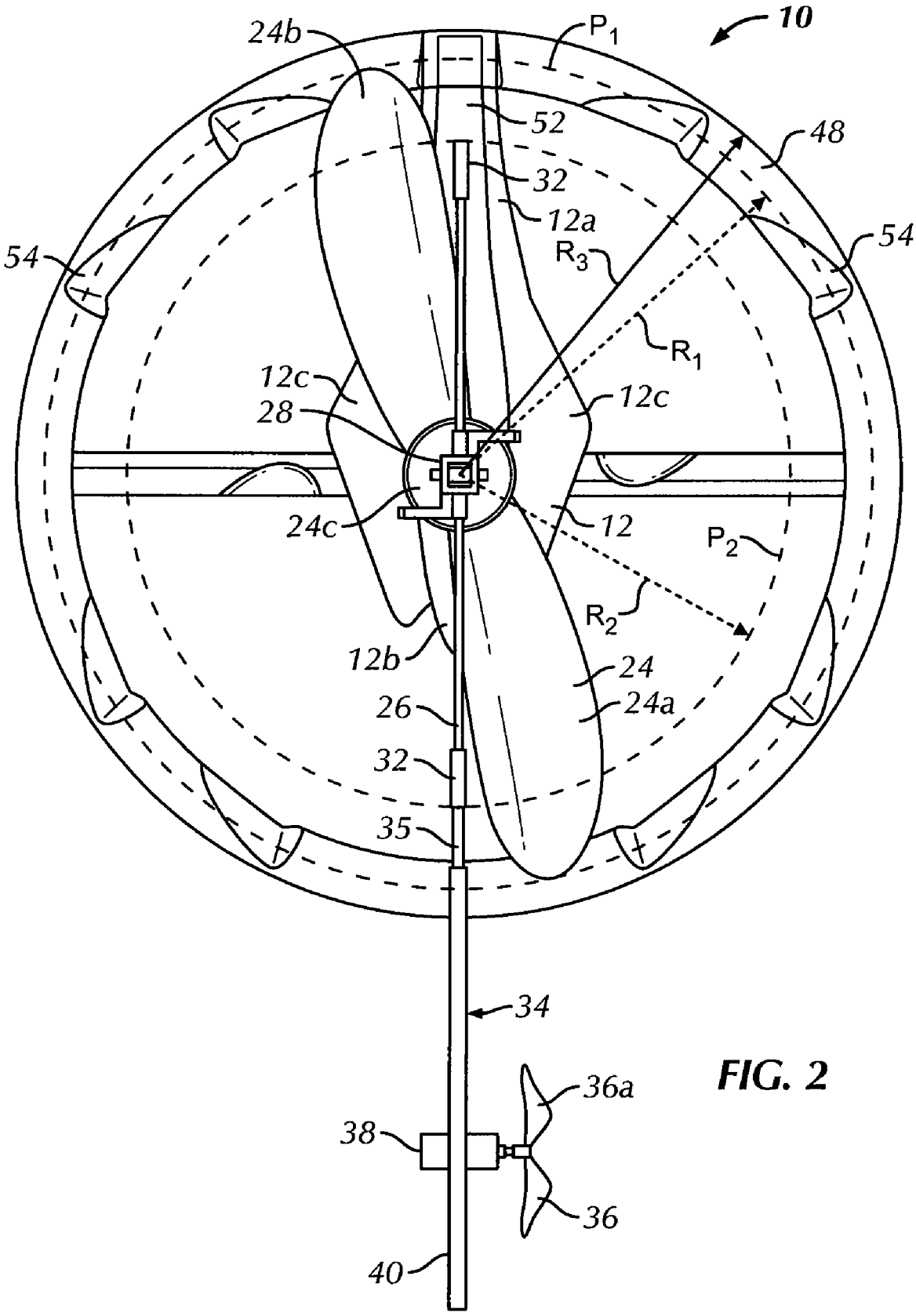
FIG. 2 is a top plan view of the toy helicopter having a stabilizing bumper shown in FIG. 1.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of a toy helicopter in accordance with the present invention, and designated parts thereof. Unless specifically set forth herein, the terms "a", "an" and "the" are not limited to one element but instead should be read as meaning "at least one". The terminology includes the words noted above, derivatives thereof and words of similar import.

Referring to the drawings in detail, wherein like reference numerals indicate like elements throughout, there is shown in FIGS. 1-4 a first preferred embodiment of a miniature toy helicopter having a stabilizing bumper (or simply "toy helicopter") 10. Though the toy helicopter 10 may resemble a real life helicopter vehicle, the toy helicopter 10 is not limited to a helicopter vehicle configuration and the toy helicopter 10 may be configured to resemble any flying vehicle capable of performing the functions as described herein.

Figure 3:
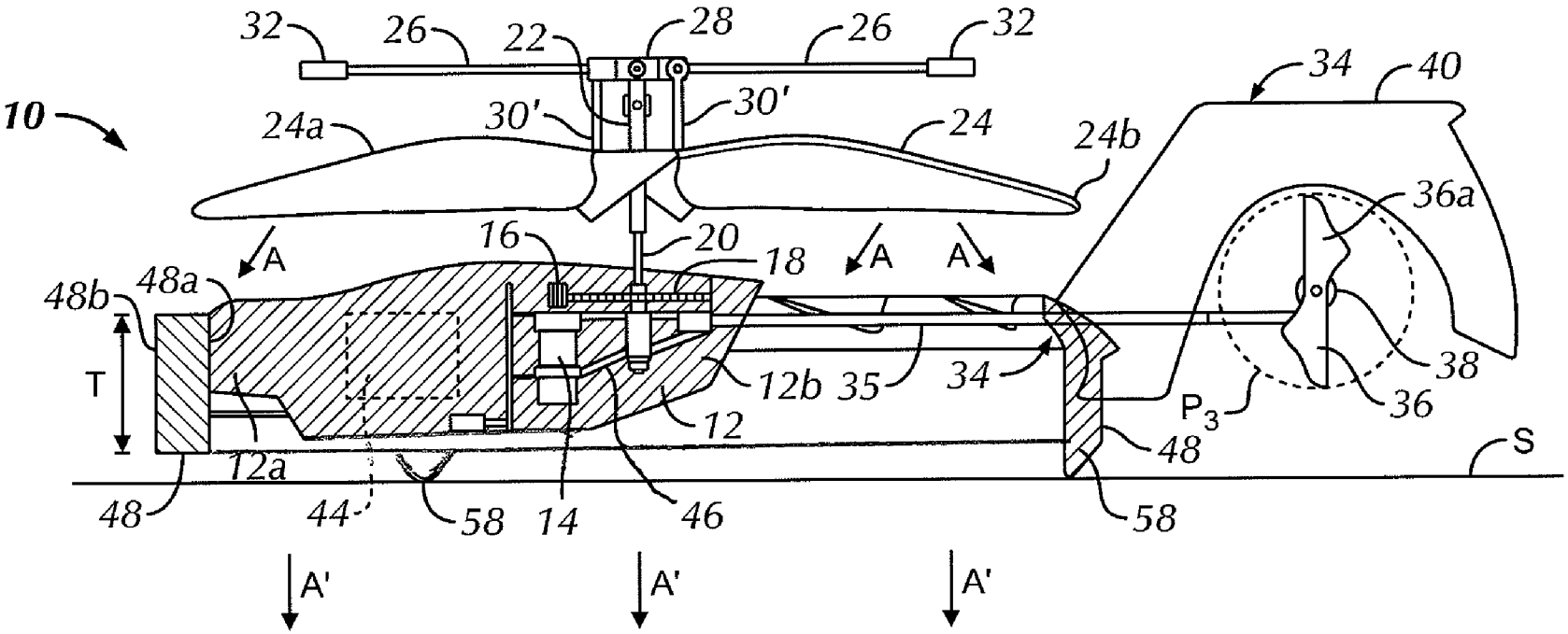
FIG. 3 is a cross-sectional view of the left side of the toy helicopter having a stabilizing bumper taken along line 3-3 in FIG. 1.

With reference to FIGS. 1-4, the toy helicopter 10 comprises a fuselage 12 having a front end 12*a* a rear end 12*b* and two lateral sides 12*c*. An imaginary center axis C extends through the fuselage 12 generally laterally centered with respect to the fuselage 12 between the two lateral sides 12*c*. The fuselage 12 is preferably shaped as a helicopter cockpit having a decorative cover 52 but the fuselage 12 may be comprised of any shape and include or not include the cover 52 configured as a fuselage or cockpit. The cover 52 is preferably affixed to the fuselage 12 by an adhesive, welding or permanent fasteners such as rivets. However, the cover 52 may be integrally formed with the fuselage 12 or releasably connected to the fuselage 12 using a mechanical fastener or snap or the cover 52 may be otherwise removably mounted to the fuselage 12 to allow for interchange of different decorative covers 52 and/or allow for access to a cockpit (not shown) for placement of an object such as a toy pilot (not shown). The fuselage 12 preferably supports or houses an electric main motor 14 (FIG. 3). The main motor 14 includes a pinion 16. The pinion 16 is drivingly connected to a larger spur gear 18. The spur gear 18 is attached to a drive shaft 20. A chassis 46 holds the main electric motor 14, the rotor shaft 20, and a tail rod 34 together.

The fuselage 12 is preferably comprised of a lightweight material such as expanded polypropylene or polystyrene. However, the fuselage 12 may be comprised of any lightweight material such as a hollow or foam polymeric material or balsa wood. Alternatively, the fuselage 12 be comprised of a more rigid material or molded around the first electric motor 14, the rotor shaft 20, and the tail rod 34 such that the chassis 46 is not necessary.

A main rotor assembly 22 is attached to the drive shaft 20. The drive shaft 20 extends upwardly from the fuselage 12 along the center axis C. The main rotor assembly 22 includes a main rotor 24 having first and second blades 24*a*, 24*b* coupled to the drive shaft 20 so as to rotate about the center axis C. The main rotor 24 has a rotational path $P_1$ having a maximum radius $R_1$ (see FIG. 2). The first and second blades 24*a*, 24*b* are preferably identical in shape but are tilted or angled along their longitudinal length in opposite directions from each other such that rotation of the rotor 24 creates lift of the toy helicopter 10. The first and second blades 24*a*, 24*b* are preferably integrally formed with a central hub 24*c* but may be separately formed and attached to a separate central hub element. The main rotor 24 may comprise more than two blades and may include additional stabilizer blades (not shown). The main rotor 24 is preferably partially pivotal around the longitudinal length of the main rotor 24 in order to work in conjunction with a stabilizing fly bar 26 to stabilize flight of the toy helicopter 10. The fly bar 26 is shown axially spaced above the main rotor 24 such that the main rotor 24 is between the fuselage 12 and the fly bar 26 but the fly bar 26 may be coplanar with the main rotor 24 or spaced between the main rotor 24 and the fuselage 12. The fly bar 26 preferably has a rotational path $P_2$ centered on the center axis C and a maximum radius $R_2$. The maximum radius $R_2$ of the fly bar 26 is preferably less than the maximum radius $R_1$ of the main rotor 24, but may be equal to or greater than the maximum radius $R_1$ of the main rotor 24. The fly bar 26 is shown in FIG. 3 to be split into two segments but the fly bar 26 may be a single element. A weight 32 is preferably provided at each end of the fly bar 26. The weights 32 help to stabilize the toy helicopter 10 because the weighted fly bar 26 spinning about the center axis C will tend to rotate about a horizontal plane due to the centrifugal force created by the weights 32. The fly bar 26 is attached to the drive shaft 20 by a fly bar head 28 and to the main rotor 24 by a pair of rotor linkages 30. The fly bar head 28 permits the fly bar 26 to pivot about an axis that is perpendicular to the center axis C and the longitudinal length of the main rotor 24. To permit the different pivotal movement of the rotor 24 and fly bar 26 to be linked, the central longitudinal axis of the fly bar is preferably angularly offset from the central longitudinal axis of the rotor, for example, about thirty degrees in advance of the leading edges of the rotor 24 (see FIG. 2). The rotor linkages 30 join the fly bar 26 with the main rotor 24 so that they pivot in unison while the fly bar 26 and the main rotor 24 rotate together on the drive shaft 20 about the center axis C.

Though the above described rotor assembly 22 is preferred, it is within the spirit and scope of the present invention that any suitable rotor assembly be utilized for providing lift and stabilization of the toy helicopter 10. For example, additional rotor blades (not shown) may be implemented either on the same plane as the rotor 24 or another rotor assembly (not shown) can be added axially spaced from the main rotor assembly 22. The additional rotor may also be a short bladed stabilizing rotor substituted for the fly bar 26 to provide stabilization with lift. Alternatively, a stabilization ring (not shown) may be provided around the main rotor 24, along the rotational path $P_1$ of the main rotor 24, or supported independently on the draft shaft 20 above or below the main rotor 24. It is preferred that the main rotor assembly 22 be constructed of a polymeric material. However, the main rotor assembly 22 may be constructed of nearly any lightweight material. If a short bladed stabilizing rotor is used, it can be made of a light weight material and weights may be added to the outer ends of its blade (not depicted). It is preferred that the drive shaft 20 and fly bar 26 be comprised of a rigid material such as metal, however the rotor shaft 20 and fly bar 26 may be constructed of any suitable material known in the art.

The tail 34 extends from the rear end 12*b* of the fuselage 12. For weight consideration, the tail 34 is preferably comprised of a thin beam 35 such as a lightweight rod or a hollow, carbon fiber tube, but may be comprised of any size and shape and constructed of any lightweight material suitable for use with the power plan provided such as a polymeric material or aluminum. A tail rotor 36 is located proximate the distal end of the tail rod 34 and is operably connected to the rear end 12*b* of the fuselage 12 through the tail rod 35. The tail rotor 36 includes at least a pair of tail rotor blades 36*a* that rotate about an axis generally perpendicular to the center axis C. The tail rotor 36 is preferably driven by an electric tail motor 38 supported from the tail rod 35. Rotation of the tail rotor 36 exerts a tangent force on the tail rod 34 and rotates the fuselage 12 about the center axis C.

The front end 12*a* of the fuselage 12 is preferably weighted such that the toy vehicle 10 slants slightly toward the front end 12*a* and travels in the direction of the front end 12*a*. The degree in which the toy vehicle slants may be controlled by adding a weight 70 (in phantom in FIG. 1) on the toy vehicle 10. The weight may be a piece of tape or an object attached by means of an adhesive or tape for adjustment. Alternatively or additionally, the weight 70 may be configured to be moved by the user along a track 72 for adjustment. Alternatively, the fuselage 12 could be weighted heavier toward the front end 12*a* and/or the tail rod 34 may include a slidably mounted weight (not shown) such that the weight distribution between the front end 12*a* and the rear end 12*b* can be adjusted by sliding the weight along the tail rod 34. Preferably, the toy vehicle 10 is generally neutrally balanced for vertical flight and moves in a radial direction only from external forces such as wind or bouncing off objects or being pushed. However, the toy vehicle 10 may include a radial direction propulsion mechanism (not shown) such as an additional rotor or a slanting or slantable drive shaft.

The tail motor 38 is preferably reversible such that the tail rotor 36 can be driven in either rotational direction but may be unidirectional. Preferably, the tail 34 includes a vertical fin 40 provided proximate the tail rotor 36 as a rudder to inhibit precession of the fuselage 12 around the center axis C while providing protection to the tail rotor 36 in its radial direction. The fin 40 preferably extends at least partially circumferentially around a rotational path P3 of the tail rotor 36 such that fin 40 prevents the tail rotor 36 from contacting objects in the radial direction (see FIG. 3).

Figure 4:
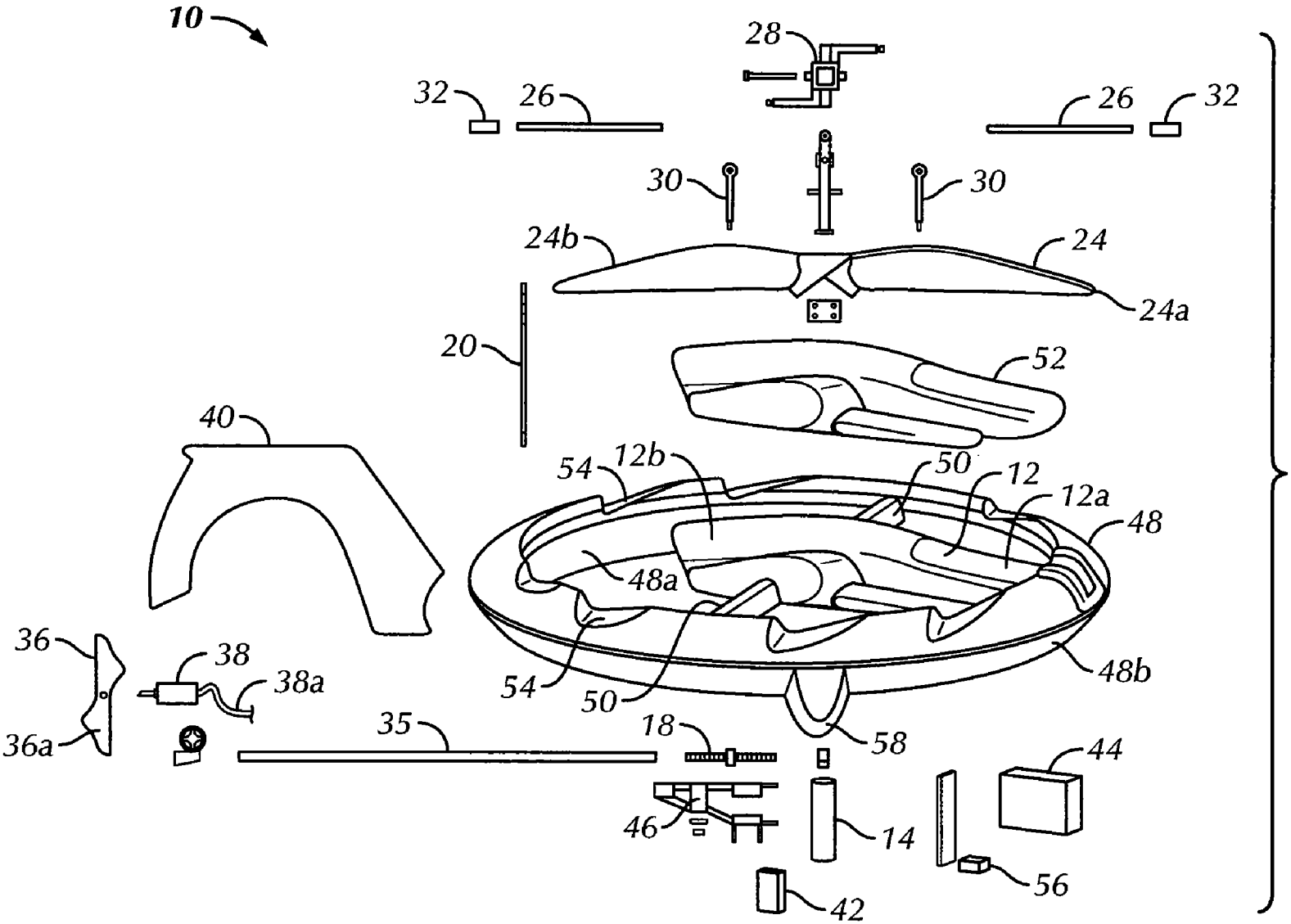
FIG. 4 is an exploded view of the toy helicopter having a stabilizing bumper of FIG. 1.

Referring to FIGS. 3 and 4, an electric power source 44, preferably a rechargeable battery or capacitor, is suitably provided, for example on or within the fuselage 12, to power the main and tail motors 14, 38. A wire 38*a* preferably extends from the tail motor 38 along the tail rod 34 to the power source 44 positioned within the fuselage 12 (FIG. 3). However, the tail motor 36 may include a separate power source (not shown). The fuselage 12 preferably includes an exposed power switch 42 for turning the toy helicopter 10 ON and OFF.

Referring to FIGS. 1-4, a bumper 48 is fixedly connected to the fuselage 12. The bumper 48 is entirely spaced axially downwardly from the main rotor 24 such that an uppermost surface 48*a* is below, spaced axially downwardly from the main rotor 24. The bumper 48 extends radially outwardly from and at least partially around the fuselage 12. Preferably, the bumper at least partially supports the fuselage 12 from the support surface S prior to take off. At least a portion of the bumper 48 has a maximum radial dimension $R_3$ measured from the center axis C that is at least as great as the maximum radii $R_1$ and $R_2$ of the main rotor 24 and fly bar 26 to provide a wide base for stability during take off and to prevent the main rotor 24 from contacting objects in the radial direction. The bumper 48 acts as a support base that is wider than the typical landing gear of a full scale helicopter (not shown) where the landing gear extends relatively closely to the fuselage. The bumper 48 helps to decrease the slant of the toy vehicle 10 during take-off resulting from an unstable lift that is typical of a lightweight toy helicopter. The bumper 48 is preferably in the form of a ring 44 that extends around the front end 12*a*, rear end 12*b* and lateral sides 12*c* of the fuselage 12 and extends at least partially axially downwardly from the fuselage 12 so as to support the fuselage on landing and take-off. The bumper 48 has a diametric dimension $R_3$ extending circumferentially around the entire bumper 48 that is at least as great as and preferably greater than the maximum diameter of the rotational path R1 of the main rotor 24. The outer periphery of the bumper 48 is preferably curved but the bumper 48 may have any suitable cross-sectional shape such as generally crescent, oval, triangular, square or spiked so long as at least a sufficient portion of the radially outermost surface of the bumper 48 extends at least as far as and preferably farther than the maximum radii $R_1$ and $R_2$ of the main rotor 24 and flybar 26. The bumper 48 is preferably positioned on an imaginary plane generally perpendicular to the center axis C. While the depicted bumper 48 forms a closed loop, the bumper 48 may not be completely closed or uniform in radial-vertical cross-section as described further below. The bumper 48 should at least substantially extend radially farther than and at least substantially surround the fuselage 12, the rotor 24 and fly bar 26 to prevent an object such as a vertical wall (not shown) from contacting the main rotor 24 during use.

When the toy vehicle 10 moving horizontally bumps into a vertical object such as a wall, the bumper 48 contacts the object and preferably rebounds the toy vehicle and/or permit the user to spin the toy vehicle around to flay away from the object without the main rotor 22 or fly bar 26 from contacting the object. The bumper 48 is axially spaced from the rotor assembly 22 such that the main rotor 24 is positioned vertically between the fly bar 26 and the bumper 48 and both the rotor 24 and fly bar 26 are located within the outer perimeter of the bumper 48 defined by tangential projection of the bumper 48 in the axial direction (i.e. parallel to the center axis C). The tail rotor 36 and tail fin 40 are preferably positioned radially outside of the bumper 48. The bumper 48 preferably has an uniform axial thickness T and generally planar, inner and outer opposing, circumferential walls 48*a*, 48*b* such that the air flow A forced downward from the main rotor 24 is channeled down through the center of the bumper 48 to create a cylinder of air A' pushed downward for creating lift of the toy helicopter 10.

At least one, and preferably a plurality, of support arms or spokes 50 extend at least generally radially between the fuselage 12 and the bumper 48. Although two support arms 50 are shown and preferred, the toy helicopter 10 may include more or fewer support arms 50. The support arms 50, along with the tail rod 34 and the front end 12*a* of the fuselage 12 connect the fuselage 12 with the bumper 48. However, only one of the tail rod 34, a support arm 50 or a portion of the fuselage 12 need to connect to the bumper 48. The support arms 50 help to space, secure and stabilize the bumper 48 to and from the fuselage 12. The support arms 50 also help to prevent turbulent and horizontal airflow from passing through the bumper 48 and helps to channel the airflow A in the vertical airflow A' direction. Furthermore, one or more of the support arms 50 is preferably pitched or angled in the same direction as the pitch of the rotor blades 24*a*, 24*b* so that the downward airflow through the support arms 50 is converted into a torque on the fuselage 12 to rotate the bumper 48 in the same direction as the main rotor 22 and oppose the counter-torque developed by the main motor 14 and fuselage 12 in rotating the drive shaft 20. The bumper 48 preferably includes notches 54 that are preferably decorative but may be shaped to reduce drag, minimize the effect of cross winds, reduce overall weight and/or impact the torque on the fuselage 12. Additionally, a plurality of feet 58 extend downwardly from the bumper 48 below the bumper 48 and the fuselage 12 (see FIG. 3) so as to raise the bumper 48 from a support surface S to help the airflow A' from the main rotor 22 be directed through the vertically extending openings between the lateral sides 12*a*, 12*b* of the fuselage 12 and the bumper 48 prior to take off until sufficient force is created by the main rotor 22 to lift the toy helicopter 10 from the support surface S.

Referring to FIG. 3, the air flow A that is generated by the main rotor 24 projects in a variety of downward directions but once it is pushed through the bumper 48 the air flow A' is primarily in a vertical or downward position. The bumper 48 and support arms 50 are preferably constructed of similar material as the fuselage 12 such as expanded polypropylene but it is within the spirit and scope of the present invention that the bumper 48 and support arms 50 be comprised of any lightweight material known in the art and that the bumper 48, support arms 50 and fuselage 12 be separately or integrally formed and comprised of more than one material.

During use, a remote control (not shown) is provided at least with a throttle control member such as a button or toggle or slide and preferably a direction control member. The first electric motor 14 rotates in response to the throttle level selected and the second electric motor 38 which is preferably reversible, rotates in response to the direction and/or throttle selected. If desired, an adjustable trim control member can be provided to control the speed of the tail motor 38 at a nominal level which prevents the fuselage 12 from precessing. The toy helicopter 10 moves vertically upward at full throttle, hovers at a hover level throttle and moves vertically downward at a throttle less than the hover level. The toy helicopter 10 preferably is only controllable in the vertical and rotational directions as previously mentioned. Outside forces such as surrounding air flow and forces exerted on the bumper 48 move the toy helicopter 10 in the horizontal or transverse direction but such movement is somewhat inhibited by the inertia of the bumper 48. The inability to remotely control the transverse direction helps to simplify the toy helicopter 10 and allows the toy helicopter 10 to translate only slightly or not at all making the toy helicopter better suited for indoor use. If horizontal translation is desired, the helicopter can be made slightly nose heavy as indicated previously, for example, by attaching a small weight such as a piece of tape on the bumper 48, to tilt the toy helicopter slightly downward at the front end 12*a*, which will cause translation in the direction of the tilt (i.e. movement in whatever is the forward direction of the toy helicopter 10). Though it is preferred that the translational movement be limited, it is also within the spirit and scope of the present invention that conventional translation controls (cyclic/collective) be provided for full movement control.

Figure 5:
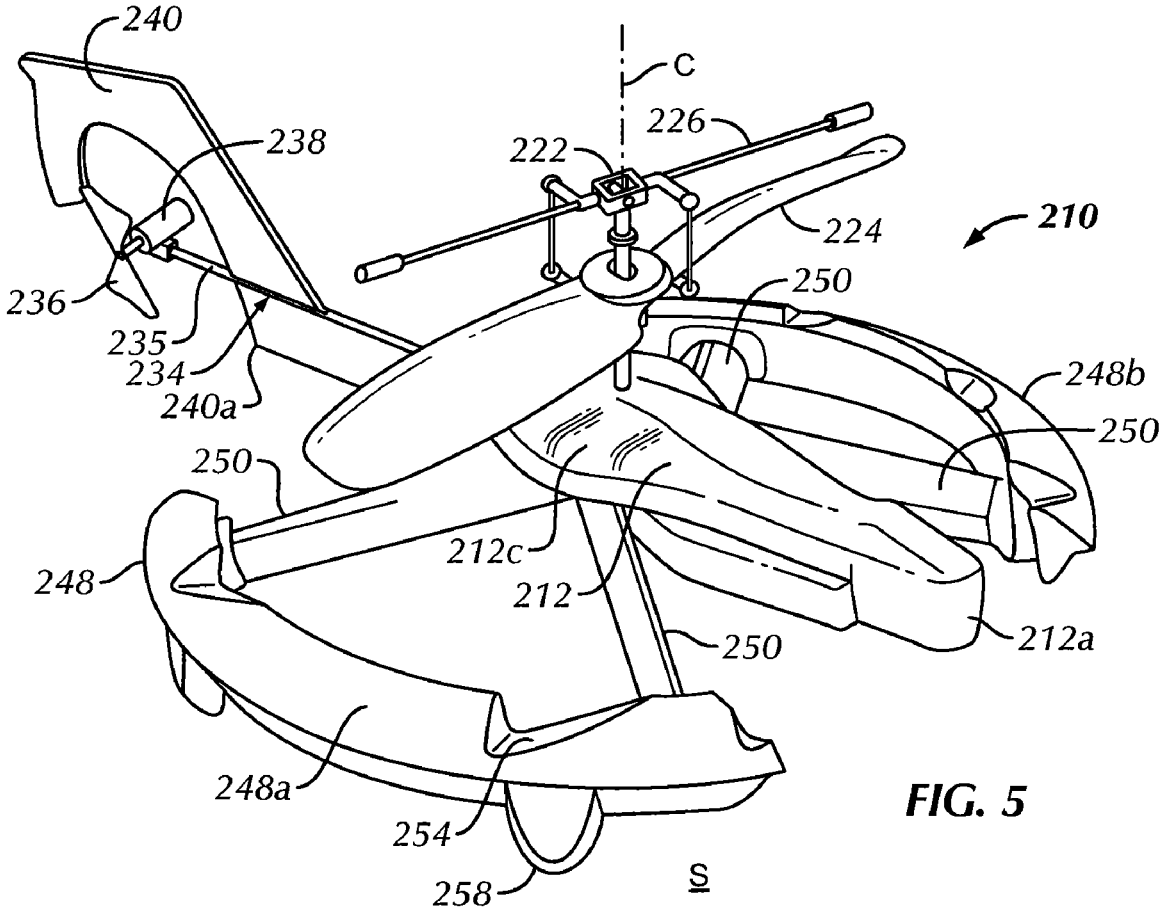
FIG. 5 is a perspective view of the upper right side of a toy helicopter having a stabilizing bumper in accordance with a second preferred embodiment of the present invention.
Figure 6:
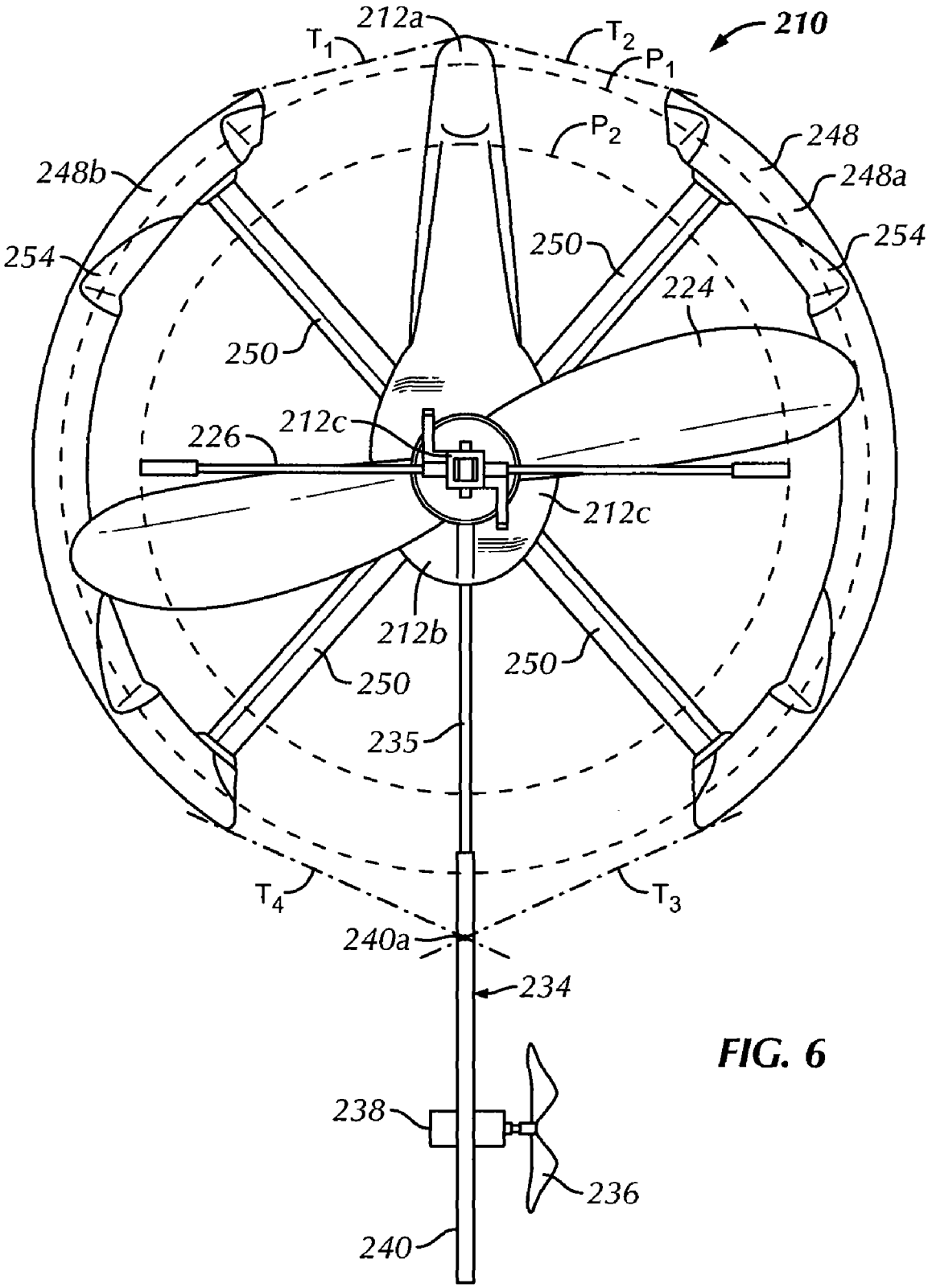
FIG. 6 is a top plan view of the toy helicopter having a stabilizing bumper shown in FIG. 5.

Referring to FIGS. 4-6, wherein similar numerals with a leading "2" correspond to similar numbers of the first embodiment 10, there is shown a second preferred embodiment 210 of the present invention. The second embodiment 210 is similar to the toy helicopter of the first embodiment 10, except as described below.

The toy vehicle 210 includes a bumper 248 comprised of first and second bumper sections 248*a*, 248*b* such that the bumper 248 is partially open toward the front end 212*a* and the rear end 212*b* of the fuselage 212. The front end 212*a* of the fuselage 212 and the tail 234 each preferably extend radially farther from the center axis C than the rotational paths $P_1$ and $P_2$ of the main rotor 224 and the fly bar 226. The bumper 248, where present, preferably extends from the lateral sides 212*c* of the fuselage 212 radially outwardly at least as far as and preferably farther than the rotational paths $P_1$ and $P_2$ of the main rotor 224 and the fly bar 226. Tangents $T_1$, $T_2$ from the front end 212*a* of the fuselage 212 to the bumper sections 248*a*, 248*b* and tangents $T_3$, $T_4$ from the bumper sections 248*a*, 248*b* to a portion 240*a* of the tail 234 are preferably also located outside of the rotational paths $P_1$ and $P_2$ whereby the rotational paths $P_1$ and $P_2$ are surrounded in the horizontal plane by the fuselage 212, the bumper 248, the tail assembly 234 and their tangents. The first and second sections 248*a*, 248*b* are preferably each crescent shaped in plan view and extend substantially past the rotational paths $P_1$ and $P_2$. However, the bumper 248 may be any suitable shape and have more or fewer gaps around the fuselage 212.

Additionally, the second embodiment of the toy helicopter 210 differs from the first embodiment of the toy helicopter 10 in that the second embodiment of the toy helicopter 210 has four support arms 250, two for each bumper section 248*a*, 248*b*, that extend from the fuselage 212 both radially and axially to sufficiently support first and second bumper sections 248*a*, 248*b* from the fuselage 212 and the raise the fuselage 212 off of the support surface S prior to take-off. However, the first and second bumper sections 248*a*, 248*b* may be connected with the fuselage 212 by one or more support arms 250 and need not extend in the axial direction.

It will be appreciated by those skilled in the art that changes could be made to the embodiments described above without departing from the broad inventive concept thereof. The toy helicopter 10, 210 is preferably controlled via radio (wireless) signals from a remote control (not shown). However, other types of controllers may be used including other types of wireless controllers (e.g. infrared, ultrasonic and/or voice-activated controllers). Alternatively, the toy helicopter 10, 210 may be self-controlled with or without preprogrammed movement. The toy helicopter 10, 210 can be constructed of, for example, plastic, polystyrene or any other suitable material such as metal or composite materials. Also, the relative dimensions of the toy helicopter 10, 210 shown can be varied, for example making components of the toy helicopter 10, 210 smaller or larger relative to the other components. It is understood, therefore, that changes could be made to the preferred embodiments of the toy helicopter 10, 210 described above without departing from the broad inventive concept thereof. It is understood, therefore, that this invention is not limited to the particular embodiments disclosed, but it is intended to cover modifications within the spirit and scope of the present invention as defined by the appended claims.

I/we claim:

1. A toy helicopter comprising:

a fuselage having a front end a rear end and two elongated lateral sides;

a main motor supported from the fuselage;

a main rotor operably connected to the motor by a rotor shaft and having at least one rotor blade rotating about a center axis concentric with the rotor shaft and generally laterally centered with respect to the fuselage, the at least one rotor blade being configured and positioned to provide lift and having a rotational path having a maximum radius; and a bumper having a central opening bigger than the fuselage with the fuselage extending elongatedly in a direction across the central opening, the bumper being fixedly connected to the fuselage and supported from the fuselage below all rotors rotating about the center axis and no higher than the fuselage, the bumper extending radially outwardly away from and at least partially around of the fuselage, at least a portion of the bumper having a maximum radial dimension from the center axis at least as great as the maximum radius of the rotational path of the main rotor.

2. The toy helicopter of claim 1 further comprising a tail including a tail rotor operably connected to the rear end of the fuselage and positioned radially outside of the bumper, the tail rotor having at least one tail rotor blade rotatable about a rotor axis, the rotor axis being generally perpendicular to the center axis.

3. The toy helicopter of claim 2, wherein the tail includes a fin extending radially from the rotor axis.

4. The toy helicopter of claim 3, wherein the fin is radially spaced from and extends at least partially circumferentially around a rotational path of the at least one tail rotor blade.

5. The toy helicopter of claim 2, wherein the tail comprises a tail rod connecting the tail rotor to the fuselage.

6. The toy helicopter of claim 2, wherein the tail rotor includes a rotor motor drivingly connected to the at least one tail rotor blade.

7. The toy helicopter of claim 1 wherein the bumper includes separated first and second sections located on either lateral side of the fuselage, the bumper being generally open proximate the front end and the rear end of the fuselage.

8. The toy helicopter of claim 7, wherein each of the first and second sections are connected to one of the lateral sides of the fuselage by at least two support arms.

9. The toy helicopter of claim 8, wherein each support arm extends outwardly from the fuselage in radial and axial directions.

10. The toy helicopter of claim 1, wherein at least one support arm extends between an inner circumferential side of the bumper and a facing one of the lateral sides of the fuselage.

11. The toy helicopter of claim 10, wherein the at least one support arm is angled axially relative to the fuselage about a length of the at least one support arm.

12. The toy helicopter of claim 1, wherein the bumper is connected to the front end of the fuselage.

13. The toy helicopter of claim 1, wherein the main rotor includes a stabilizing fly bar spaced axially from the at least one rotor blade, the fly bar having a rotational path centered on the center axis and a maximum radius less than the maximum radial dimension of the bumper.

14. The toy helicopter of claim 1, wherein the bumper is a generally circular closed ring extending completely around the front, lateral sides and rear of the fuselage and having a diametric dimension extending circumferentially around the entire bumper that is at least as great as a maximum diameter of the rotational path of the at least one rotor blade.

15. The toy helicopter of claim 1, wherein the bumper is constructed of a foam material.

16. The toy helicopter of claim 1, wherein the bumper has a generally circular inner wall with a minimum diameter less than a maximum diameter of the rotational path of the at least one rotor blade and an opposing generally circular outer wall with a maximum diameter greater than the maximum diameter of the rotational path of the at least one blade.

17. The toy helicopter of claim 14 wherein the bumper has opposing inner and outer circumferential walls defining the ring and being at least generally concentric in plan view and wherein the fuselage extends elongatedly across a diameter of the ring such that the front and rear ends of the fuselage point in opposing diametric directions from a center of the ring and at least the lateral sides of the fuselage are spaced away from the bumper so as to define a vertically extending opening between each lateral side and the bumper.

18. The toy helicopter of claim 17 wherein the fuselage extends to and connects directly with the bumper only at the front end of the fuselage.

19. The toy helicopter of claim 1 further comprising a plurality of feet extending downwardly from the bumper below the bumper and the fuselage so as to raise the bumper and the fuselage from a support surface and help airflow from the main rotor through the bumper prior to take off of the toy helicopter from the support surface.

20. A toy helicopter comprising:

an elongated fuselage having a front end, a rear end and two lateral sides;

a main motor supported from the fuselage;

at least one main rotor supported above the fuselage by a rotor shaft operably connecting the main rotor to the main motor to provide lift, the rotor shaft having a concentric center axis; and a bumper fixedly connected with the fuselage so as to be located no higher than the fuselage, the bumper having an uppermost surface spaced axially downwardly from all rotors rotating about the center axis, the bumper having at least a center opening with an inner wall facing the fuselage and the center axis and an outer wall facing away from the fuselage and the center axis, the outer wall having a maximum radial dimension from the center axis at least as great as a maximum radius of rotational paths of all rotors rotating about the center axis.

21. A toy helicopter comprising:

a fuselage having a front end, a rear end and two lateral sides;

a main motor supported from the fuselage;

at least one lift rotor supported above the fuselage by a rotor shaft operably connecting the lift rotor to the main motor, the rotor shaft having a concentric center axis; and bumper means fixedly connected with the fuselage so as to be positioned no higher than the fuselage and positioned entirely below all objects supported from the rotor shaft above the fuselage and having at least one central opening sufficiently large to extend radially outwardly from at least the two lateral sides of the fuselage for channeling air from at least the lift rotor around the fuselage and through the bumper means to create lift and the bumper means extending radially outwardly from the central axis beyond all objects rotating on the rotor shaft for preventing contact of any object rotating on the rotor shaft with a vertical wall while the center axis is also vertical.

* * * * *